United States Patent [19]

Russell

[11] Patent Number: 4,646,715

[45] Date of Patent: Mar. 3, 1987

[54] EXTENSION APPARATUS FOR DAMPER CONTROL SHAFT

[76] Inventor: Jerry A. Russell, 25 Roaring Springs Rd., Joshua, Tex. 76058

[21] Appl. No.: 885,293

[22] Filed: Jul. 14, 1986

[51] Int. Cl.[4] ..... F23L 3/00

[52] U.S. Cl. ..... 126/292; 126/285 R; 126/295; 403/299; 411/417; 411/437

[58] Field of Search ..... 126/285 R, 286, 288, 126/289, 291-296; 403/299; 411/437, 418, 417

[56] References Cited

U.S. PATENT DOCUMENTS

| | | | |
|---|---|---|---|
| 2,106,093 | 1/1938 | Goese | 126/292 |
| 2,130,476 | 9/1938 | Young | 126/295 |
| 2,183,292 | 12/1939 | Kerentoff | 126/292 |
| 2,230,882 | 2/1941 | Cameron | 126/295 |
| 2,323,038 | 6/1943 | Heasley et al. | 126/292 |
| 2,362,623 | 11/1944 | Fossum | 126/292 |
| 2,488,006 | 11/1949 | De Roo | 126/285 R |
| 2,966,169 | 12/1960 | Reece | 137/375 |
| 3,722,499 | 3/1973 | Lukjan | 126/292 |
| 4,500,224 | 2/1985 | Ewing | 403/299 |

FOREIGN PATENT DOCUMENTS

| | | | |
|---|---|---|---|
| 11683 | 5/1903 | Fed. Rep. of Germany | 126/292 |

*Primary Examiner*—James C. Yeung

*Attorney, Agent, or Firm*—James C. Fails; William T. Wofford; Arthur F. Zobal

[57] ABSTRACT

There is disclosed an extension apparatus for a damper assembly having an extension member for effectively extending the damper assembly control shaft and a securing member for securing the extension member onto the control shaft.

4 Claims, 7 Drawing Figures

EXTENSION APPARATUS FOR DAMPER CONTROL SHAFT

FIELD OF THE INVENTION

The present invention relates to dampers of the type found in ducts and more particularly to damper controls.

BACKGROUND OF THE INVENTION

Damper assemblies in ductwork include a movable damper capable of occluding the interior of the duct, a control shaft attached to the damper and extending through an opening in the duct to the exterior, a handle fitted onto the control shaft, and means for securing the handle onto the control shaft such as a nut.

Damper assemblies contained within short sections of a duct are commonly available in complete units, having been assembled at the factory. The control shafts on the prefabricated assemblies extend out from the duct only a short distance. When the damper assembly is wrapped with insulation, along with the rest of the ductwork, the control shaft does not extend out past the insulation, making the installation of the handle onto the control shaft difficult. The handle could be installed onto the short control shaft by compressing the insulation around the control shaft. This diminishes the effectiveness of the insulation however, and creates difficulty when trying to rotate the handle. Attempts to weld an extension onto the control shaft have proven to be unsatisfactory because of the expense involved and the probability of melting the surrounding insulation.

Accordingly, it is an object of the present invention to provide an apparatus that will effectively extend the control shaft of a damper assembly without difficulty.

DESCRIPTION OF A PREFERRED EMBODIMENT

Figure 1:
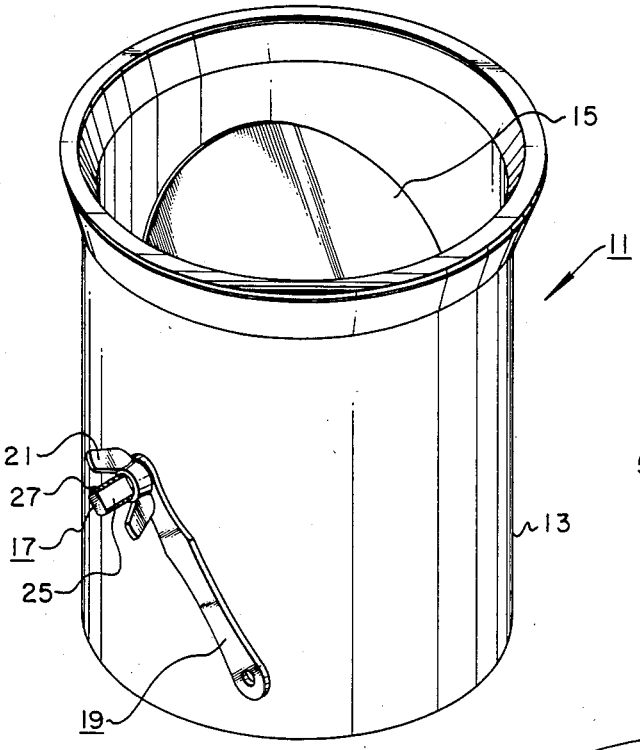
Fig. 1 Prior Art
FIG. 1 is a schematic isometric view of a damper assembly in accordance with the prior art.

In FIG. 1, there is shown a damper assembly 11 in accordance with the prior art. The damper assembly 11, which is inserted into ductwork to control the flow of air, includes a portion or section of a duct 13, a damper 15, a control shaft 17, a handle 19 and a wing nut 21.

The duct section 13 is of a conventional type, being suitable for conveying air through its interior portion and having ends that allow coupling to the other duct sections in order to make a length of ductwork suitable for the particular need. Inside of the duct section 13 is the damper 15 which is dimensioned so as to occlude the interior portion of the duct section when properly positioned thereby preventing the flow of air from one end of the duct section to the other. The damper 15 may be made to rotate about an axis that is perpendicular to the duct section longitudinal axis from a position that occludes the duct section interior portion to various positions that control the flow of air.

The control shaft 17 is coupled to the damper 15 in such a way so as to be coaxial with the damper axis of rotation. The control shaft 17 extends from the damper 15 outwardly through an opening 23 in the duct section 13 (see FIG. 6). The outer end portion of the control shaft 17 is generally cylindrical with flat keying sides 25 that are parallel to one another, resulting in the control shaft having a first transverse configuration of two oppositely facing arcuate sides 27 merging with two oppositely facing flat sides 25 (see FIG. 7). The arcuate sides 27 are threaded for cooperating with the wing nut 21 in securing the handle.

Figure 6:
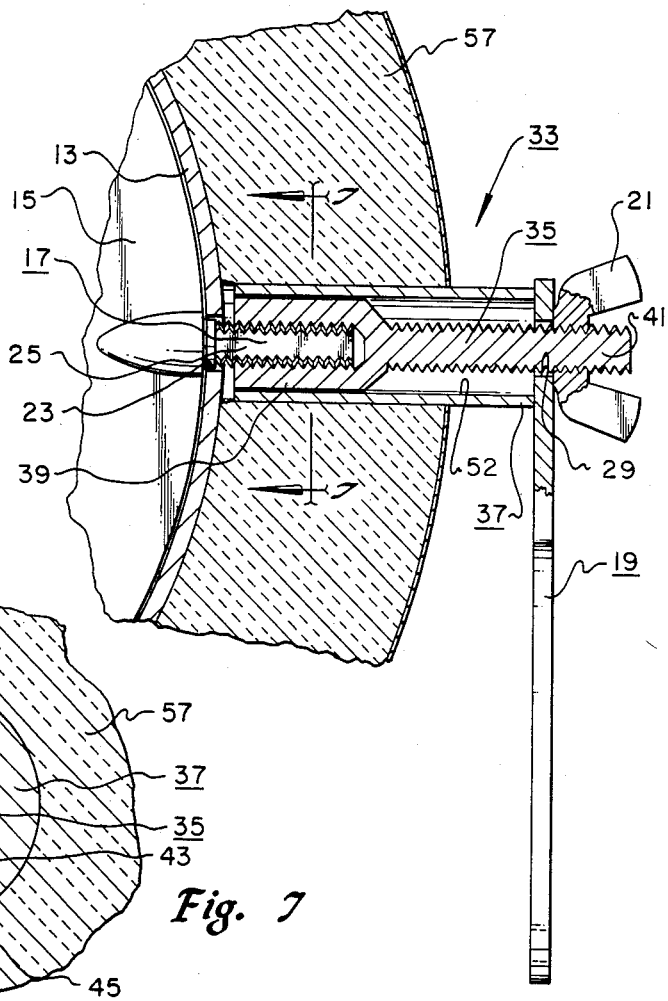
FIG. 6 is a schematic longitudinal cross sectional view of the extension apparatus as installed onto a damper control shaft.

The handle 19 is a thin strip of metal having an aperture 29 in one end for receiving the control shaft 17 (see FIG. 6). The aperture 29 has a longitudinal axis that is coaxial to the control shaft longitudinal axis when the control shaft 17 is inserted into the aperture. The aperture 29 has a second transverse configuration which corresponds to the control shaft first transverse configuration of two oppositely facing arcuate sides merging with two oppositely facing flat sides. These corresponding transverse configurations allow the handle 19 to be nonrotatably coupled to the control shaft 17. Thus, whenever the handle 19 is rotated, the control shaft 17 also rotates. The handle 19 is secured onto the control shaft 17 by the wing nut 21.

Figure 2:
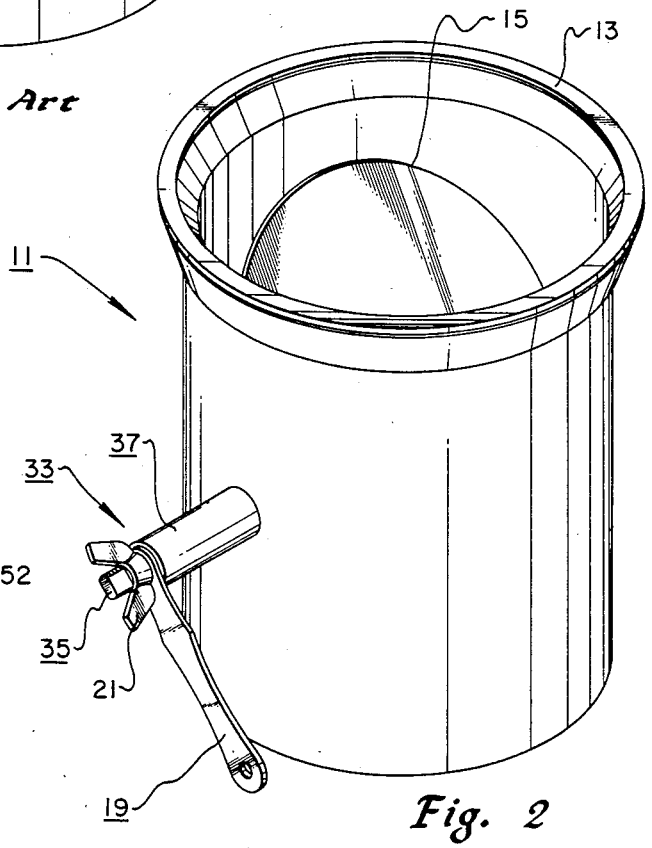
FIG. 2 is a schematic isometric view of the damper assembly of FIG. 1 on which the extension apparatus of the present invention in accordance with a preferred embodiment has been installed.

FIG. 2 illustrates the extension apparatus 33 of the present invention in accordance with a preferred embodiment as installed on the above described damper assembly 11. The extension apparatus 33 includes an extension member 35 and a securing member 37.

Figure 3:
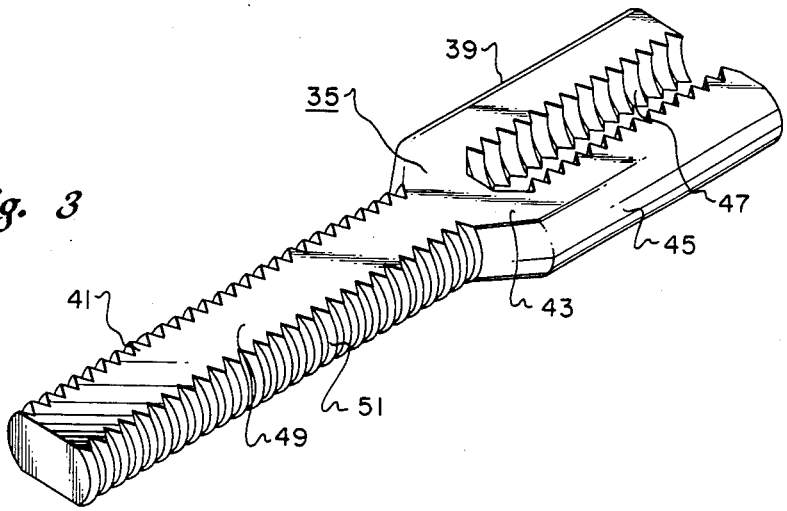
FIG. 3 is a schematic isometric view of an extension member.

Referring to FIG. 3, the extension member 35 has a connector portion 39 and a shaft portion 41. The connector portion has two flat sides 43 that are parallel to one another and extend between an open end and a closed end. The thickness of the connector portion 39, as measured between the flat sides 43, is the same as the distance between the control shaft flat sides 25. The connector portion 39 has arcuate sides 45 extending between the flat sides. A threaded bore 47 extends longitudinally inward from the open end and receives the outer end portion of the control shaft 17. The diameter of the bore 47 is greater than the thickness of the connector portion 39. As a result, the bore 47 bifurcates the open end of the connector portion 39. The bore 47 is open on two sides, and has a third transverse configuration that is similar to the control shaft first transverse configuration of two oppositely facing arcuate sides. The arcuate sides of the bore 47 are threaded to matingly engage the threaded control shaft and to secure the extension member 35 onto the control shaft 17.

Extending longitudinally outward from the closed end of the connector portion 39, in an integral manner, is the shaft portion 41. The longitudinal axis of the shaft portion 41 is coaxial with the longitudinal axis of the connector portion bore 47. The shaft portion 41 has flat sides 49 and arcuate sides 51 with a resultant fourth configuration that corresponds to the first transverse configuration of the control shaft 17. This correspondence of transverse configurations allows the handle 19 to be nonrotatably coupled to the shaft portion 41 of the extension member, in the same manner as the handle is nonrotatably coupled to the control shaft 17. The arcuate sides 51 are threaded for cooperating with the wing nut in securing the handle 19 onto the shaft portion. The respective shaft portion flat sides 49 are coplanar with the respective connector portion flat sides 43.

Figure 5:
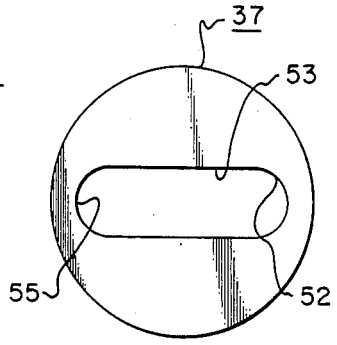
FIG. 5 is a schematic end view of a securing member.
Figure 4:
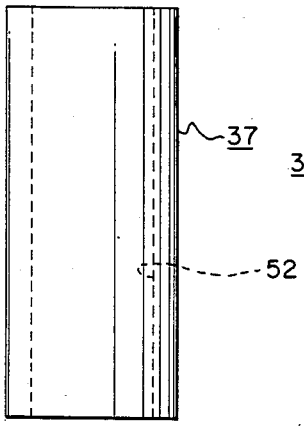
FIG. 4 is a schematic plan view of a securing member.

The securing member 37, illustrated in FIGS. 4 and 5, is a right circular cylinder having a length which is shorter than the extension member 35. The shorter length of the securing member 37 allows the extension member 35 to protrude past the securing member and receive the handle 19. The securing member has a cavity 52 with sidewalls 53, 55 that extend longitudinally the length of the cylinder. The cavity 52 has a transverse configuration that corresponds to the transverse configuration of the connector portion and thus will matingly receive the connector portion 39. Accordingly, the cavity 52 has parallel flat sidewalls 53 that merge with oppositely disposed arcuate sidewalls 55.

Figure 7:
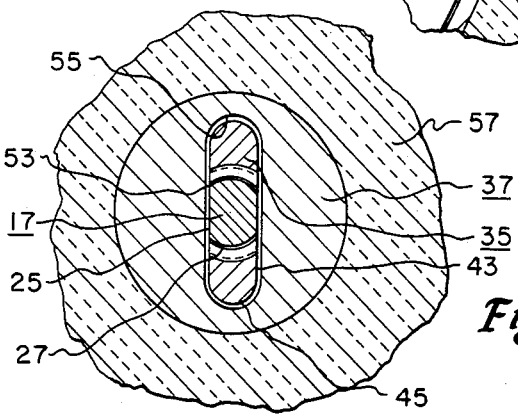
FIG. 7 is a schematic transverse cross sectional view taken along lines 7—7 of FIG. 6.

The installation of the extension apparatus 33 onto a damper assembly control shaft 17 will now be explained with particular reference to FIGS. 6 and 7. It is desired to wrap the damper assembly 11 with a blanket of insulation 57 having a thickness that exceeds the length of the outer portion of the control shaft 17, thereby necessitating the use of an extension for the handle 19. The first step is to remove the wing nut 21 and the handle 19 from the damper assembly control shaft 17. Then, the extension member 35 is screwed onto the control shaft. When the open end of the extension member connector portion is near the damper section 13, or the control shaft 17 has reached the end of the extension member threaded bore 47, the extension member is aligned with the control shaft such that the respective extension member flat sides 43, 49 are flush with the respective control shaft flat sides 25. This alignment operation exposes the control shaft flat sides 25. Next, the securing member 37 is assembled onto the extension member 35 such that the shaft portion 41 extends through the cavity 52. The cavity flat sidewalls 53 of the securing member are adjacent to the shaft portion flat sides 49. The handle 19 is assembled onto the extension member shaft portion 41 and secured in place against the securing member 37 by the wing nut 21. Finally, the damper assembly 11 may be wrapped with insulation 57.

The use of the extension apparatus effectively extends the length of the control shaft beyond the insulation 57 so that the handle may be easily installed and rotated. The extension member 35, which effectively extends the length of the control shaft, is secured onto the control shaft 17 by the securing member 37. The handle is nonrotatably coupled onto the extension member shaft portion 41. Thus, as the handle is rotated, the extension member 35 rotates the control shaft 17.

The foregoing disclosure and the showings made in the drawings are merely illustrative of the principles of this invention and are not to be interpreted in a limiting sense.

I claim:

1. An extension apparatus for use with a damper assembly, said damper assembly including a portion of a duct, a damper located inside of said duct, a control shaft coupled to said damper and extending outside of said duct, a handle, and means for securing said handle onto said control shaft, said damper being rotatable about an axis to enable said damper to selectively control fluid flow through said duct, said control shaft having a first transverse configuration, said handle having an aperture for receiving said control shaft, said aperture having a second transverse configuration, said first and second transverse configurations allowing nonrotative coupling of said handle to said control shaft, said control shaft also having a means for cooperating with said means for securing said handle, comprising:

a. an extension member for effectively extending the length of said control shaft comprising:

i. a connector portion having a closed end and an open end, said open end having a bore for receiving the portion of said control shaft that extends outside of said duct, said bore having means for securing said extension member onto said control shaft and having a third transverse configuration, whereby a portion of said control shaft inside of said bore is exposed, ii. a shaft portion extending longitudinally from the closed end of said connector portion, having a means for cooperating with said means for securing said handle and having a fourth transverse configuration that allows said shaft portion to be received by said handle aperture, said fourth and second transverse configurations allowing nonrotative coupling of said handle to said shaft portion, b. a securing member for securing said extension member onto said control shaft, having a cavity with sidewalls, said cavity being shaped to receive said connector portion such that a portion of said cavity sidewalls is adjacent to said control shaft exposed portion, said securing member having a length that is shorter than said extension member such that said handle may be secured onto said shaft portion as said shaft portion emerges from said securing member cavity.

2. An extension apparatus for use with a damper assembly, said damper assembly including a portion of a duct, a damper located inside of said duct, a control shaft coupled to said damper and extending outside of said duct, a handle, and means for securing said handle onto said control shaft, said damper being rotatable about an axis to enable said damper to selectively control fluid flow through said duct, said control shaft having a transverse configuration with at least one flat side and at least one arcuate side, said handle having an aperture for receiving said control shaft, said aperture having a transverse configuration that corresponds to said control shaft transverse configuration and allows nonrotative coupling of said handle to said control shaft, comprising:

a. an extension member for effectively extending the length of said control shaft comprising:

i. a connector portion having a closed end and an open end, said open end having a bore for receiving the portion of said control shaft that extends outside of said duct, said bore having a transverse configuration that is similar to said control shaft transverse configuration, whereby said control shaft flat side inside of said bore is exposed, ii. a shaft portion extending longitudinally from the closed end of said connector portion having a transverse configuration that corresponds to said control shaft transverse configuration and allows nonrotative coupling of said handle to said shaft portion, b. a securing member for securing said extension member onto said control shaft, having a cavity with sidewalls, said cavity being shaped to matingly receive said connector portion such that a portion of said cavity sidewalls is adjacent to said control shaft flat side, said securing member having a length that is shorter than said extension member such that said handle may be secured onto said shaft portion as said shaft portion emerges from said securing member cavity.

3. The extension apparatus of claim 2 wherein the arcuate sides of said control shaft and said shaft portion are threaded.

4. The extension apparatus of claim 3 wherein the connector portion has a second transverse configuration and the securing member cavity has a transverse configuration that corresponds to the second transverse configuration of said connector portion.

* * * * *